US008970336B2

(12) United States Patent
Uchida

(10) Patent No.: US 8,970,336 B2
(45) Date of Patent: Mar. 3, 2015

(54) METHOD OF MANUFACTURING AN ELECTRONIC COMPONENT

(71) Applicant: Murata Manufacturing Co., Ltd., Kyoto (JP)

(72) Inventor: Katsuyuki Uchida, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/249,293

(22) Filed: Apr. 9, 2014

(65) Prior Publication Data

US 2014/0247103 A1 Sep. 4, 2014

Related U.S. Application Data

(60) Division of application No. 13/332,192, filed on Dec. 20, 2011, now Pat. No. 8,732,939, which is a continuation of application No. PCT/JP2010/058449, filed on May 19, 2010.

(30) Foreign Application Priority Data

Jun. 24, 2009 (JP) ..... 2009-149243

(51) Int. Cl.
*H01F 5/00* (2006.01)

(52) U.S. Cl.
USPC ..... 336/200

(58) Field of Classification Search
USPC ..... 336/65, 83, 200, 232–234, 206–208
See application file for complete search history.

(56) References Cited

U.S. PATENT DOCUMENTS

| | | | |
|---|---|---|---|
| 7,605,682 | B2 | 10/2009 | Nakao et al. |
| 7,694,414 | B2 | 4/2010 | Maeda et al. |
| 7,994,889 | B2 | 8/2011 | Okabe et al. |

FOREIGN PATENT DOCUMENTS

| | | | |
|---|---|---|---|
| JP | 11-144958 | A | 5/1999 |
| JP | 2005-045108 | A | 2/2005 |
| JP | 2005-259774 | A | 9/2005 |
| JP | 2006-318946 | A | 11/2006 |
| JP | 2008-078229 | A | 4/2008 |
| JP | 2008-078234 | A | 4/2008 |
| WO | 2007/088194 | A2 | 8/2007 |

OTHER PUBLICATIONS

International Search Report; PCT/JP2010/058449; Jul. 6, 2010.
Written Opinion of the International Searching Authority; PCT/JP2010/058449; Jul. 6, 2010.

(Continued)

*Primary Examiner* — Tuyen Nguyen
(74) *Attorney, Agent, or Firm* — Studebaker & Brackett PC

(57) ABSTRACT

An electronic component capable of preventing the occurrence of magnetic saturation due to a magnetic flux surrounding each coil conductor and a method of manufacturing the electronic component are provided. The electronic component includes a laminate formed by stacking unit layers, where each unit layer includes a first insulating layer, and a coil conductor and second insulating layer formed on the first insulating layer. Each second insulating layer has a Ni content greater than a Ni content of each first insulating layer. Portions of the first insulating layers have a Ni content lower than a Ni content of the second portions after the laminate is calcined.

1 Claim, 5 Drawing Sheets

(56) References Cited

OTHER PUBLICATIONS

"Notice on the first Office Action" issued by the State Intellectual Property Office of the People's Republic of China on Feb. 26, 2014, which corresponds to Chinese Patent Application No. 201080028775.X and is related to U.S. Appl. No. 13/332,192.

The Office Action issued by the Korean Intellectual Property Office on Feb. 13, 2013, which corresponds to Korean Patent Application No. 10-2011-7030595 and is related to U.S. Appl. No. 13/332,192.

METHOD OF MANUFACTURING AN ELECTRONIC COMPONENT

CROSS REFERENCE TO RELATED APPLICATIONS

The present application is a continuation of International Application No. PCT/JP2010/058449 filed May 19, 2010, which claims priority to Japanese Patent Application No. 2009-149243 filed Jun. 24, 2009, the entire contents of each of these applications being incorporated herein by reference in their entirety.

TECHNICAL FIELD

The present invention relates to electronic components and method of manufacturing the same and particularly relates to an electronic component including a coil and a method of manufacturing the same.

BACKGROUND

Conventional electronic components known as open magnetic circuit-type laminated coil components are disclosed in, for example, Japanese Unexamined Patent Application Publication No. 2005-259774 (Patent Literature 1). FIG. 8 is a sectional view of an open magnetic circuit-type laminated coil component 500 disclosed in Patent Literature 1.

As shown in FIG. 8, the open magnetic circuit-type laminated coil component 500 includes a laminate 502 and a coil L. The laminate 502 is composed of a plurality of laminated magnetic layers. The coil L has a spiral shape and includes a plurality of coil conductors 506 connected to each other. The open magnetic circuit-type laminated coil component 500 further includes a non-magnetic layer 504. The non-magnetic layer 504 is placed in the laminate 502 so as to cross the coil L.

In the open magnetic circuit-type laminated coil component 500, a magnetic flux ϕ500 surrounding the coil conductors 506 passes through the non-magnetic layer 504. This prevents the occurrence of magnetic saturation due to the excessive concentration of the magnetic flux in the laminate 502. Therefore, the open magnetic circuit-type laminated coil component 500 has excellent direct current superposition characteristics.

SUMMARY

The present disclosure provides an electronic component capable of preventing the occurrence of magnetic saturation due to a magnetic flux surrounding each coil conductor and a method of manufacturing the electronic component.

In one aspect of the disclosure, a method of manufacturing an electronic component includes steps of forming a laminate and calcining the laminate. The laminate includes a spiral coil including a plurality of connected coil conductors overlapping each other in plan view in a stacking direction, and a plurality of continuously stacked unit layers. Each of the unit layers includes a first insulating layer overlaid with one of the coil conductors and a second insulating layer having a greater Ni content than the first insulating layer. Each of the second insulting layers of the first unit layers is provided on portions of the first insulating layer other than where the one coil conductor is formed.

In another aspect of the disclosure, an electronic component includes a plurality of unit layers. Each of the unit layers include a single sheet-shaped first insulating layer, a coil conductor on the first insulating layer, and a second insulating layer on a portion of the first insulating layer other than where the coil conductor is provided. The unit layers are continuously stacked such that the coil conductors are connected to each other to form a spiral coil. The first insulating layers include first portions sandwiched between the coil conductors in the stacking direction and second portions other than the first portions. The first portions have a Ni content lower than a Ni content of the second portions. The Ni content of the second portions is lower than a Ni content of the second insulating layers.

DETAILED DESCRIPTION

The inventor realized that in the open magnetic circuit-type laminated coil component 500, a magnetic flux ϕ502 surrounding each coil conductor 506 is present in addition to the magnetic flux ϕ500 surrounding the coil conductors 506. The magnetic flux ϕ502 causes magnetic saturation in the open magnetic circuit-type laminated coil component 500.

Electronic components according to exemplary embodiments of the disclosure, which are capable of preventing the occurrence of magnetic saturation due to a magnetic flux surrounding each coil conductor, and methods of manufacturing the electronic components, will now be described.

Figure 1:
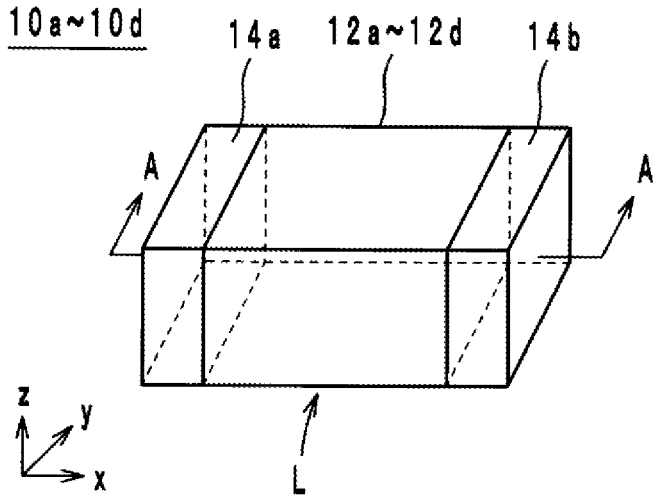
FIG. 1 is a perspective view of an electronic component according to an exemplary embodiment.
Figure 2:
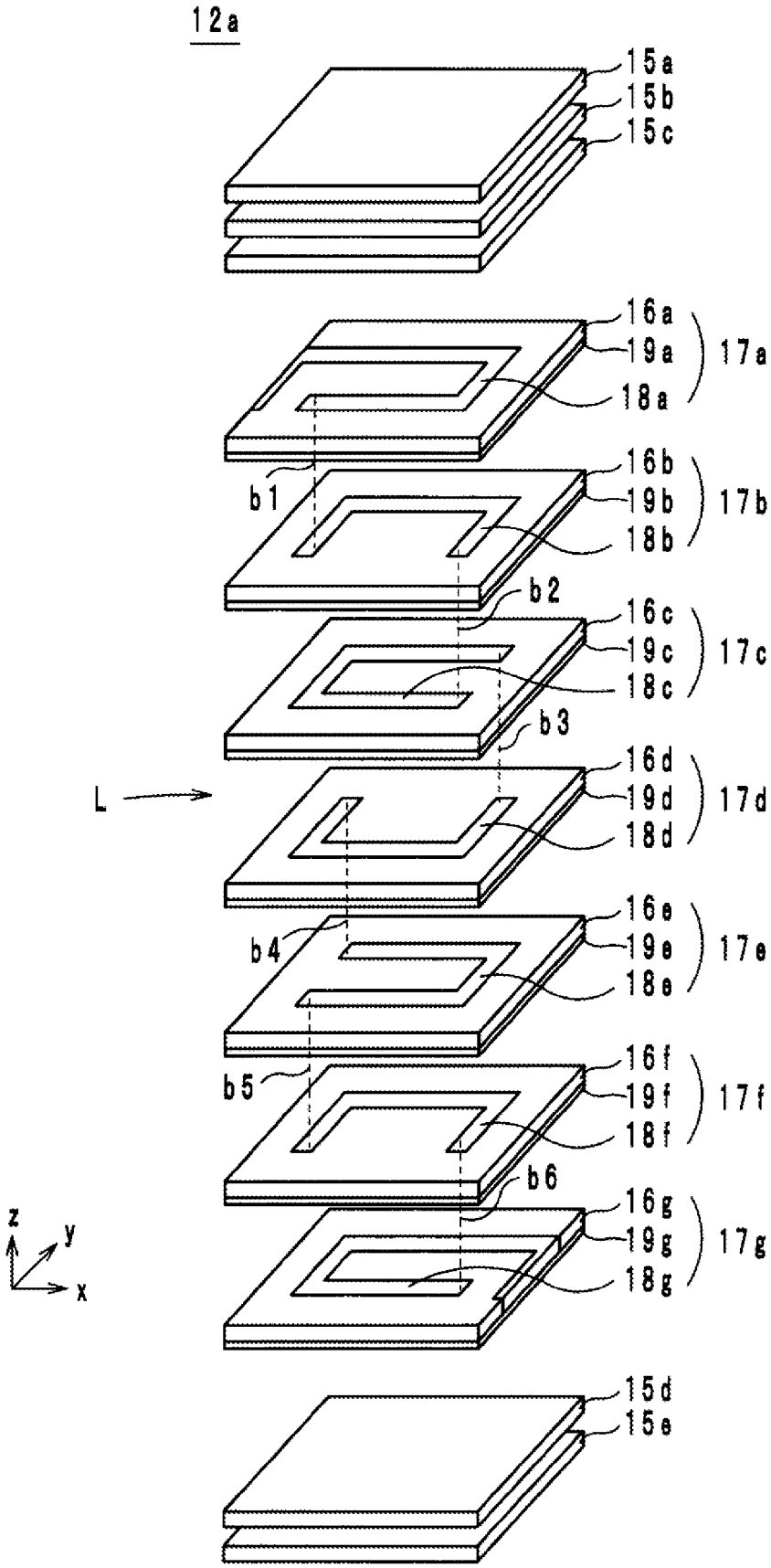
FIG. 2 is an exploded perspective view of a laminate included in an electronic component according to the embodiment.
Figure 3:
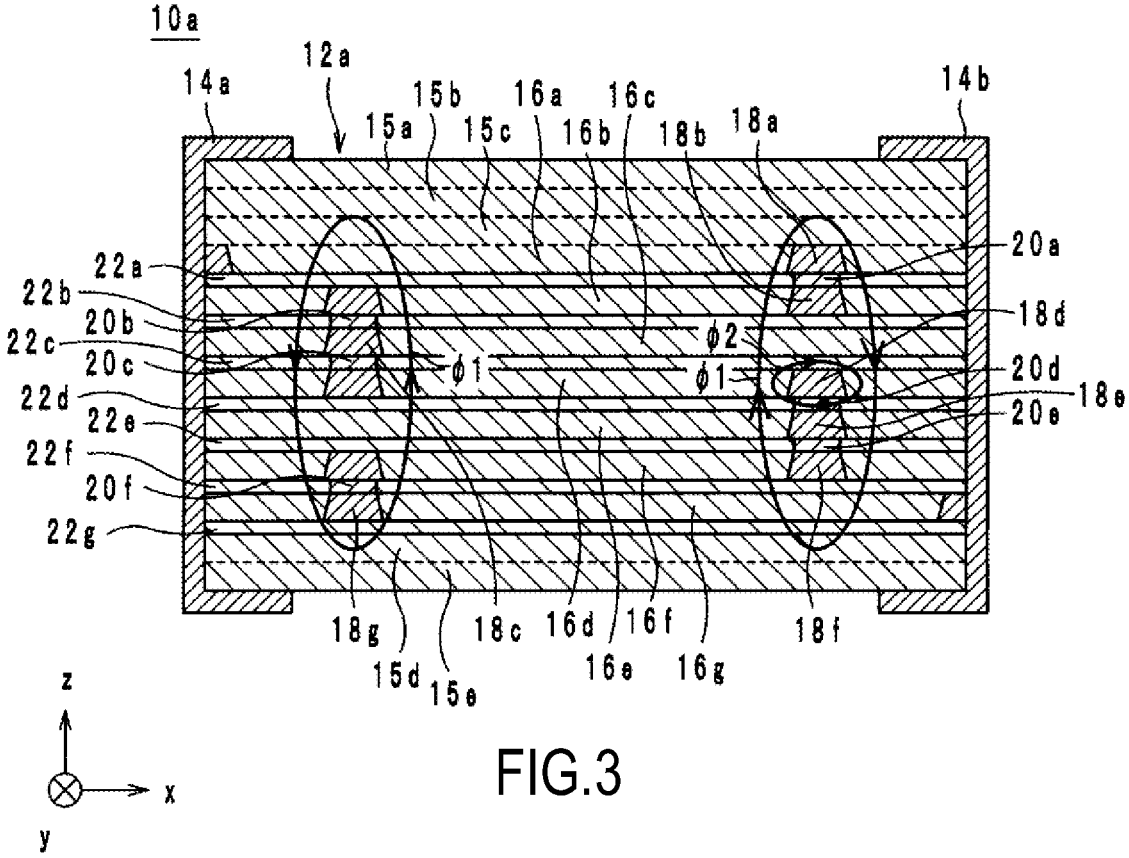
FIG. 3 is a sectional view of the electronic component taken along the line A-A of FIG. 1.

An electronic component according to an exemplary embodiment is described below with reference to FIGS. 1-3. FIG. 1 is a perspective view of electronic components 10*a* to 10*d* according to embodiments. FIG. 2 is an exploded perspective view of a laminate 12*a* included in the electronic component 10*a* according to an embodiment. FIG. 3 is a structural sectional view of the electronic component 10*a* taken along the line A-A of FIG. 1. The laminate 12*a* shown in FIG. 2 is in an uncalcined state. The electronic component 10*a* shown in FIG. 3 is in a calcined state calcination. Hereinafter, the stacking direction of the electronic component 10*a* is defined as a z-axis direction, a direction along a long side of the electronic component 10*a* is defined as an x-axis direction, and a direction along a short side of the electronic component 10*a* is defined as a y-axis direction. The x-axis, y-axis, and z-axis are orthogonal to each other.

With reference to FIG. 1, the electronic component 10*a* includes the laminate 12*a* and external electrodes 14*a* and 14*b*. The laminate 12*a* has a rectangular parallelepiped shape and includes a coil L (not explicitly shown in FIG. 1). The external electrodes 14*a* and 14*b* are electrically connected to the coil L and are each arranged on a corresponding one of side surfaces of the laminate 12*a* that are opposed to each other. In this embodiment, the external electrodes 14*a* and 14*b* are arranged to cover the two side surfaces, which are located at both ends of the component in the x-axis direction.

As shown in FIG. 2, the laminate 12*a* is composed of insulating layers 15*a* to 15*e*, 16*a* to 16*g*, and 19*a* to 19*g*; coil conductors 18*a* to 18*g*; and via-hole conductors b1 to b6. Each of the insulating layers 15*a* to 15*e* has a rectangular shape and is a single sheet-shaped magnetic layer made of Ni—Cu—Zn ferrite. The insulating layers 15*a* to 15*c* are stacked in that order on the positive side of a region containing the coil conductors 18*a* to 18*g* in the z-axis direction and form a covering. The insulating layers 15*d* and 15*e* are stacked in that order on the negative side of the region containing the coil conductors 18*a* to 18*g* in the z-axis direction and form another covering.

As shown in FIG. 2, the insulating layers 19*a* to 19*g* are rectangular and have a first Ni content. In this embodiment, the insulating layers 19*a* to 19*g* are non-magnetic layers made of Cu—Zn ferrite containing no Ni. The uncalcined insulating layers 19*a* to 19*g* are non-magnetic; however, the calcined insulating layers 19*a* to 19*g* are partly magnetic. This is described below.

As shown in FIG. 2, the coil conductors 18*a* to 18*g* are made of a conductive material containing Ag, have a length equal to a ¾ turn, and form the coil L together with the via-hole conductors b1 to b6. The coil conductors 18*a* to 18*g* are each arranged on a corresponding one of the insulating layers 19*a* to 19*g*. One end of the coil conductor 18*a* is exposed on a side of the insulating layer 19*a* that is located on a negative side of the insulating layer in the x-axis direction and serves as a lead conductor. This end of the coil conductor 18*a* is connected to the external electrode 14*a* shown in FIG. 1. One end of the coil conductor 18*g* is exposed on the positive side of the insulating layer 19*g* in the x-axis direction and serves as a lead conductor. This end of the coil conductor 18*g* is connected to the external electrode 14*b* shown in FIG. 1. The coil conductors 18*a* to 18*g* overlap each other to form a single rectangular ring in plan view in the z-axis direction.

As shown in FIG. 2, the via-hole conductors b1 to b6 extend through the insulating layers 19*a* to 19*f* in the z-axis direction and connect the coil conductors 18*a* to 18*g* neighboring each other in the z-axis direction. In particular, the via-hole conductor b1 connects the other end of the coil conductor 18*a* to one end of the coil conductor 18*b*. The via-hole conductor b2 connects the other end of the coil conductor 18*b* to one end of the coil conductor 18*c*. The via-hole conductor b3 connects the other end of the coil conductor 18*c* to one end of the coil conductor 18*d*. The via-hole conductor b4 connects the other end of the coil conductor 18*d* to one end of the coil conductor 18*e*. The via-hole conductor b5 connects the other end of the coil conductor 18*e* to one end of the coil conductor 18*f*. The via-hole conductor b6 connects the other end of the coil conductor 18*f* to the other end of the coil conductor 18*g* (one end of the coil conductor 18*g* serves as a lead conductor, as described above). As described above, the coil conductors 18*a* to 18*g* and the via-hole conductors b1 to b6 form the coil L. The coil L has a coil axis extending in the z-axis direction and is spiral.

As shown in FIG. 2, the insulating layers 16*a* to 16*g* are arranged on portions of the insulating layers 19*a* to 19*g* other than the coil conductors 18*a* to 18*g*. Therefore, principal surfaces of the insulating layers 19*a* to 19*g* are covered with the insulating layers 16*a* to 16*g* and the coil conductors 18*a* to 18*g*. A principal surface of each of the insulating layers 16*a* to 16*g* and a principal surface of a corresponding one of the coil conductors 18*a* to 18*g* form a single plane and are flush with each other. The insulating layers 16*a* to 16*g* have a second Ni content higher than the first Ni content. In this embodiment, the insulating layers 16*a* to 16*g* are magnetic layers made of Ni—Cu—Zn ferrite.

The insulating layers 19*a* to 19*g* are thinner than the insulating layers 16*a* to 16*g*. In particular, the insulating layers 19*a* to 19*g* have a thickness of 5 μm to 15 μm and the insulating layers 16*a* to 16*g* have a thickness of 25 μm.

The insulating layers 16*a* to 16*g* and 19*a* to 19*g* and coil conductors 18*a* to 18*g* configured as described above form unit layers 17*a* to 17*g*. The unit layers 17*a* to 17*g* are continuously arranged between a group of the insulating layers 15*a* to 15*c* and a group of the insulating layers 15*d* and 15*e* in that order, thereby forming the laminate 12*a*.

After the laminate 12*a* is calcined and the external electrodes 14*a* and 14*b* are formed thereon, the electronic component 10*a* has a cross-sectional structure as shown in FIG. 3. In particular, the Ni content of portions of the insulating layers 19*a* to 19*g* is increased to exceed the first Ni content during the calcination of the laminate 12*a*. That is, during calcination the insulating layers 19*a* to 19*g* are partly transformed from non-magnetic layers to magnetic layers.

As shown in FIG. 3 in detail, in the electronic component 10*a*, the insulating layers 19*a* to 19*g* include first portions 20*a* to 20*f* and second portions 22*a* to 22*g*. The first portions 20*a* to 20*f* correspond to portions of the insulating layers 19*a* to 19*f* that are sandwiched between the coil conductors 18*a* to 18*g* in the z-axis direction. In particular, the first portion 20*a* corresponds to a portion of the insulating layer 19*a* that is sandwiched between the coil conductors 18*a* and 18*b*. The first portion 20*b* corresponds to a portion of the insulating layer 19*b* that is sandwiched between the coil conductors 18*b* and 18*c*. The first portion 20*c* corresponds to a portion of the insulating layer 19*c* that is sandwiched between the coil conductors 18*c* and 18*d*. The first portion 20*d* corresponds to a portion of the insulating layer 19*d* that is sandwiched between the coil conductors 18*d* and 18*e*. The first portion 20*e* corresponds to a portion of the insulating layer 19*e* that is sandwiched between the coil conductors 18*e* and 18*f*. The first portion 20*f* corresponds to a portion of the insulating layer 19*f* that is sandwiched between the coil conductors 18*f* and 18*g*. The second portions 22*a* to 22*g* correspond to portions of the insulating layers 19*a* to 19*f* other than the first portions 20*a* to 20*f*. However, no first portion (i.e., no portion "20*g*") is present in the insulating layer 19*g*, but the second portion 22*g* is present in that layer. This is because the insulating layer 19*g* is located on a more negative side in the z-axis direction as compared with the insulating layer 18*g*, which is located on the most negative side in the z-axis direction.

The first portions 20*a* to 20*f* have a Ni content lower than the Ni content of the second portions 22*a* to 22*g*. In this embodiment, the first portions 20*a* to 20*f* contain no Ni. Therefore, the first portions 20*a* to 20*f* are non-magnetic. In contrast, the second portions 22*a* to 22*g* contain Ni. Therefore, the second portions 22*a* to 22*g* are magnetic. The Ni content of the second portions 22*a* to 22*g* is lower than the Ni content of the insulating layers 16*a* to 16*g*.

A method of manufacturing the electronic component 10*a* is now described below with reference to FIG. 2. In the method, the electronic component 10*a* is manufactured together with a plurality of electronic components 10*a* as described below.

Ceramic green sheets for forming the insulating layers 19*a* to 19*g* are prepared as shown in FIG. 2. In particular, raw materials are prepared by weighing ferric oxide ($Fe_2O_3$), zinc oxide (ZnO), and copper oxide (CuO) at a predetermined ratio and are charged into a ball mill, followed by wet mixing.

An obtained mixture is dried and is then pulverized. An obtained powder is calcined at 800° C. for one hour. The calcined powder is wet-pulverized in a ball mill, is dried, and is then disintegrated, whereby a ferrite ceramic powder is obtained.

The ferrite ceramic powder is mixed with a binder (vinyl acetate, a water-soluble acrylic resin, or the like), a plasticizer, a humectant, and a dispersant in a ball mill, followed by defoaming under reduced pressure. An obtained ceramic slurry is formed into sheets on a carrier sheet by a doctor blade process and the sheets are dried, whereby the ceramic green sheets for forming the insulating layers 19*a* to 19*g* are prepared.

Ceramic green sheets for forming the insulating layers 15*a* to 15*e* are prepared as shown in FIG. 2. In particular, raw materials are prepared by weighing ferric oxide ($Fe_2O_3$), zinc oxide (ZnO), nickel oxide (NiO), and copper oxide (CuO) at a predetermined ratio and are charged into a ball mill, followed by wet mixing. An obtained mixture is dried and is then pulverized. An obtained powder is calcined at 800° C. for one hour. The calcined powder is wet-pulverized in a ball mill, is dried, and is then disintegrated, whereby a ferrite ceramic powder is obtained.

This ferrite ceramic powder is mixed with a binder (vinyl acetate, a water-soluble acrylic resin, or the like), a plasticizer, a humectant, and a dispersant in a ball mill, followed by defoaming under reduced pressure. An obtained ceramic slurry is formed into sheets on a carrier sheet by a doctor blade process and the sheets are dried, whereby the ceramic green sheets for forming the insulating layers 15*a* to 15*e* are prepared.

Ceramic green sheets for forming the insulating layers 16*a* to 16*g* are prepared as shown in FIG. 2. In particular, raw materials are prepared by weighing ferric oxide ($Fe_2O_3$), zinc oxide (ZnO), nickel oxide (NiO), and copper oxide (CuO) at a predetermined ratio and are charged into a ball mill, followed by wet mixing. An obtained mixture is dried and is then pulverized. An obtained powder is calcined at 800° C. for one hour. The calcined powder is wet-pulverized in a ball mill, is dried, and is then disintegrated, whereby a ferrite ceramic powder is obtained.

This ferrite ceramic powder is mixed with a binder (vinyl acetate, a water-soluble acrylic resin, or the like), a plasticizer, a humectant, and a dispersant in a ball mill, followed by defoaming under reduced pressure, whereby a ceramic slurry for ceramic layers for forming the insulating layers 16*a* to 16*g* is obtained.

As shown in FIG. 2, the via-hole conductors b1 to b6 are each formed on a corresponding one of the ceramic green sheets for forming the insulating layers 19*a* to 19*f*. In particular, a laser beam is applied to the ceramic green sheets for forming the insulating layers 19*a* to 19*f*, whereby via-holes are formed therein. The via-holes are filled with a conductive paste containing Ag, Pd, Cu, Au, an alloy thereof, or the like by a process such as printing or painting.

As shown in FIG. 2, the coil conductors 18*a* to 18*g* are formed on the ceramic green sheets for forming the insulating layers 19*a* to 19*g*. In particular, a conductive paste made of Ag, Pd, Cu, Au, an alloy thereof, or the like is applied to the ceramic green sheets for forming the insulating layers 19*a* to 19*g* by a process such as screen printing or photolithography, whereby the coil conductors 18*a* to 18*g* are formed. The formation of the coil conductors 18*a* to 18*g* and the filling of the via-holes with the conductive paste can be performed in the same step or in different steps.

As shown in FIG. 2, ceramic green layers for forming the insulating layers 16*a* to 16*g* are formed on portions of the ceramic green sheets for forming the insulating layers 19*a* to 19*g*, the portions being other than the coil conductors 18*a* to 18*g*. In particular, a ceramic paste is applied thereto by a process such as screen printing or photolithography, whereby the ceramic green layers for forming insulating layers 16*a* to 16*g* are formed. Through the above steps, ceramic green layers for forming the unit layers 17*a* to 17*g* are formed as shown in FIG. 2.

As shown in FIG. 2, the ceramic green sheets for forming the insulating layers 15*a* to 15*c*, the ceramic green layers for forming the unit layers 17*a* to 17*g*, and the ceramic green sheets for forming the insulating layers 15*d* and 15*e* are stacked in that order and are then press-bonded, whereby an uncalcined mother laminate is obtained. In particular, the ceramic green sheets for forming the insulating layers 15*a* to 15*c*, the ceramic green layers for forming the unit layers 17*a* to 17*g*, and the ceramic green sheets for forming the insulating layers 15*d* and 15*e* are stacked one by one and are preliminarily press-bonded and the uncalcined mother laminate is then pressed by isostatic pressing, whereby final press bonding is performed.

The coil L is formed during stacking because the ceramic green layers for forming the unit layers 17*a* to 17*g* are continuously arranged in the z-axis direction. This allows the coil conductors 18*a* to 18*g* and the insulating layers 19*a* to 19*g* to be alternately arranged in the uncalcined mother laminate in the z-axis direction as shown in FIG. 2.

The mother laminate is cut into laminates 12*a* with a predetermined size (2.5 mm×2.0 mm×1.0 mm) with a cutting blade, whereby the uncalcined laminates 12*a* are obtained. The uncalcined laminates 12*a* are degreased and are calcined. Degreasing is performed at, for example, 500° C. for two hours in a low-oxygen atmosphere. Calcination is performed at, for example, 870-900° C. for 2.5 hours.

During calcination, Ni diffuses from the insulating layers 15*c*, 16*a* to 16*g*, and 15*d* to the insulating layers 19*a* to 19*g*. In particular, the second portions 22*a* to 22*g* of the insulating layers 19*a* to 19*g* are in contact with the insulating layers 15*c*, 16*a* to 16*g*, and 15*d* as shown in FIG. 3 and therefore Ni diffuses from the insulating layers 15*c*, 16*a* to 16*g*, and 15*d* to the second portions 22*a* to 22*g*. Therefore, the second portions 22*a* to 22*g* become magnetized. The Ni content of the second portions 22*a* to 22*g* is lower than the second Ni content of the insulating layers 15*c*, 16*a* to 16*g*, and 15*d*.

In contrast, the first portions 20*a* to 20*f* of the insulating layers 19*a* to 19*f* are not in contact with the insulating layers 15*c*, 16*a* to 16*g*, and 15*d* and therefore no Ni diffuses from the insulating layers 15*c*, 16*a* to 16*g*, and 15*d* to the first portions 20*a* to 20*f*. Thus, the first portions 20*a* to 20*f* remain non-magnetic. The first portions 20*a* to 20*f* originally contain no Ni and, however, can contain Ni, which diffuses from the second portions 22*a* to 22*g*. Therefore, the first portions 20*a* to 20*f*, while essentially free of Ni, may contain a slight or a trace amount of Ni so as not be magnetic.

Through the above steps, the calcined laminates 12*a* are obtained. The laminates 12*a* are chamfered by barreling. An electrode paste made of silver is applied to the laminates 12*a* by, for example, a dipping process or the like and the laminates 12*a* are then baked, whereby silver electrodes for forming external electrodes 14*a* and 14*b* are formed. The silver electrodes are baked at 800° C. for one hour.

Finally, the silver electrodes are plated with Ni and Sn, whereby the external electrodes 14*a* and 14*b* are formed. Through the above steps, the electronic component 10*a* shown in FIG. 1 is completed.

In the electronic component 10*a* and the method, the occurrence of magnetic saturation due to a magnetic flux surrounding each of the coil conductors 18*a* to 18*f* can be prevented as described below. In particular, as shown in FIG. 3, when a current flows through the coil L of the electronic component 10*a*, a magnetic flux ϕ1 which has a relatively long flux path and which entirely surrounds the coil conductors 18*a* to 18*f* is generated and magnetic fluxes ϕ2 which have a relatively short flux path and which each surround a corresponding one of the coil conductors 18*a* to 18*f* are generated (only a magnetic flux ϕ2 surrounding the coil conductor 18*d* is shown in FIG. 3). The magnetic fluxes ϕ2, as well as the magnetic flux ϕ1, can cause magnetic saturation in the electronic component 10*a*.

In each electronic component 10*a* manufactured by the method, the first portions 20*a* to 20*f* of the insulating layers 19*a* to 19*f* are sandwiched between the coil conductors 18*a* to 18*g* in the z-axis direction and are non-magnetic. Therefore, the magnetic fluxes ϕ2, which each surround a corresponding one of the coil conductors 18*a* to 18*f*, pass through the first portions 20*a* to 20*f*, which are non-magnetic. Thus, the magnetic fluxes ϕ2 have excessively high flux density; hence, magnetic saturation is prevented from occurring in the electronic component 10*a*. This allows the electronic component 10*a* to have enhanced direct current superposition characteristics.

The inventor has performed computer simulations as described below for the purpose of clarifying effects resulting from the electronic component 10*a* and the method. In particular, a first model corresponding to the electronic component 10*a* and a second model including magnetic layers corresponding to the insulating layers 19*a* to 19*g* of the electronic component 10*a* have been manufactured. Simulation conditions are as described below:

The number of turns in the coil L: 8.5 turns

The size of the electronic component: 2.5 mm×2.0 mm×1.0 mm

The thickness of the insulating layers 19*a* to 19*g*: 10 μm

Figure 4:
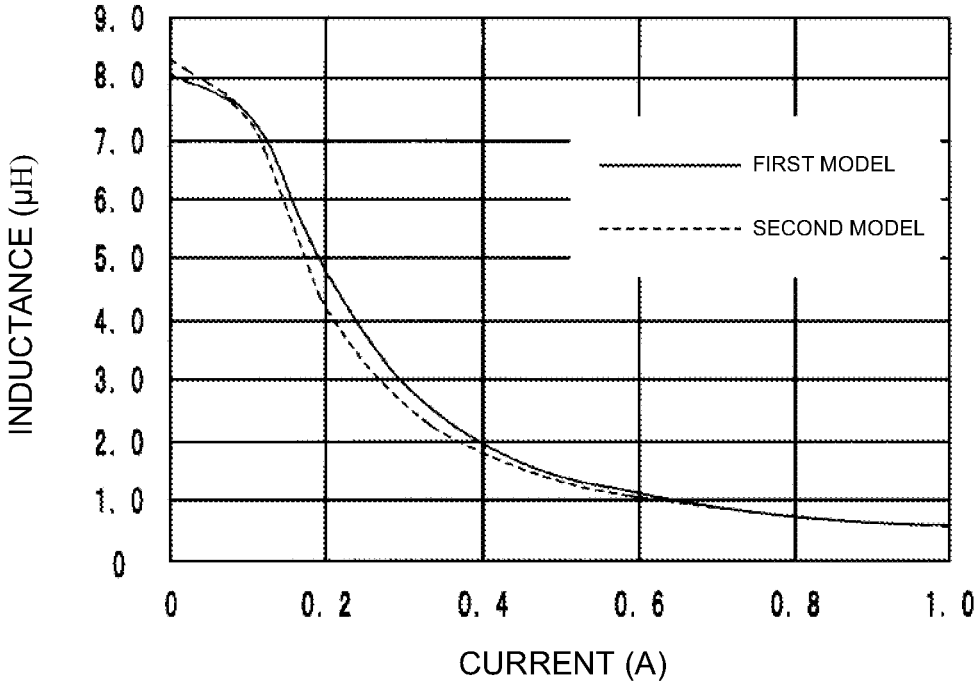
FIG. 4 is a graph showing simulation results.

FIG. 4 is a graph showing the simulation results. The ordinate represents the inductance and the abscissa represents the current. As is clear from FIG. 4, the inductance of the first model decreases more gently with an increase in current as compared to the second model. That is, the first model has direct current superposition characteristics more excellent than those of the second model. This means that magnetic saturation is more likely to occur due to a magnetic flux surrounding each coil electrode in the second model than the first model. As is clear from the above, in the electronic component 10*a* and the method, magnetic saturation can be prevented from occurring due to the magnetic fluxes ϕ2, which each surround a corresponding one of the coil conductors 18*a* to 18*f*.

In the electronic component 10*a* and the method, non-magnetic layers are the first portions 20*a* to 20*f*, which are sandwiched between the coil conductors 18*a* to 18*f*. Thus, the magnetic flux ϕ1, which surrounds the coil conductors 18*a* to 18*f*, does not pass through any non-magnetic layer. Therefore, the electronic component 10*a* can achieve high inductance.

In the electronic component 10*a* and the method, the first portions 20*a* to 20*f*, which are non-magnetic, can be accurately formed. In a common electronic component, in order to form a non-magnetic layer on a portion sandwiched between coil conductors, a process of applying a non-magnetic paste to the portion sandwiched between the coil conductors by printing may be used.

However, in the case of using the process of applying the non-magnetic paste thereto, the non-magnetic layer may possibly extend outside the portion sandwiched between the coil conductors because of misprinting or misalignment. When the non-magnetic layer extends outside the portion sandwiched between the coil conductors, the non-magnetic layer may possibly disturb a magnetic flux which entirely surrounds the coil conductors and which has a long flux path. That is, a magnetic flux other than a desired magnetic flux passes through the non-magnetic layer.

In the electronic component 10*a* and the method, after the laminate 12*a* is prepared, the first portions 20*a* to 20*f*, which are non-magnetic, are formed during calcination. Therefore, misprinting or misalignment does not cause the first portions 20*a* to 20*f* to extend outside portions sandwiched between the coil conductors 18*a* to 18*f*. In the electronic component 10*a* and the method, the first portions 20*a* to 20*f*, which are non-magnetic, can be accurately formed. Therefore, unlike the desired magnetic fluxes ϕ2, the magnetic flux ϕ1 is prevented from passing through any non-magnetic layer.

In the electronic component 10*a*, the unit layers 17*a* to 17*g* are continuously arranged between a group of the insulating layers 15*a* to 15*c* and a group of the insulating layers 15*d* and 15*e* in that order. This allows non-magnetic layers to be present only in the first portions 20*a* to 20*f*, which are sandwiched between the coil conductors 18*a* to 18*g*. Therefore, no non-magnetic layer crossing the coil L is present.

In the electronic component 10*a* and the method, the insulating layers 19*a* to 19*g* preferably have a thickness of 5 μm to 15 μm. When the thickness of the insulating layers 19*a* to 19*g* is less than 5 μm, it is difficult to prepare the ceramic green sheets for forming the insulating layers 19*a* to 19*g*. In contrast, when the thickness of the insulating layers 19*a* to 19*g* is more than 15 μm, Ni does not diffuse sufficiently and therefore it is difficult to magnetize the second portions 22*a* to 22*g*.

No non-magnetic layer crossing the coil L is present in the electronic component 10*a*. However, in the electronic component 10*a*, non-magnetic layers may be present on portions other than the first portions 20*a* to 20*f*. This is because direct current superposition characteristics of the electronic component and the inductance thereof can be adjusted using such non-magnetic layers. Electronic components, according to modifications, including non-magnetic layers placed on portions other than the first portions 20*a* to 20*f* are now described.

Figure 5:
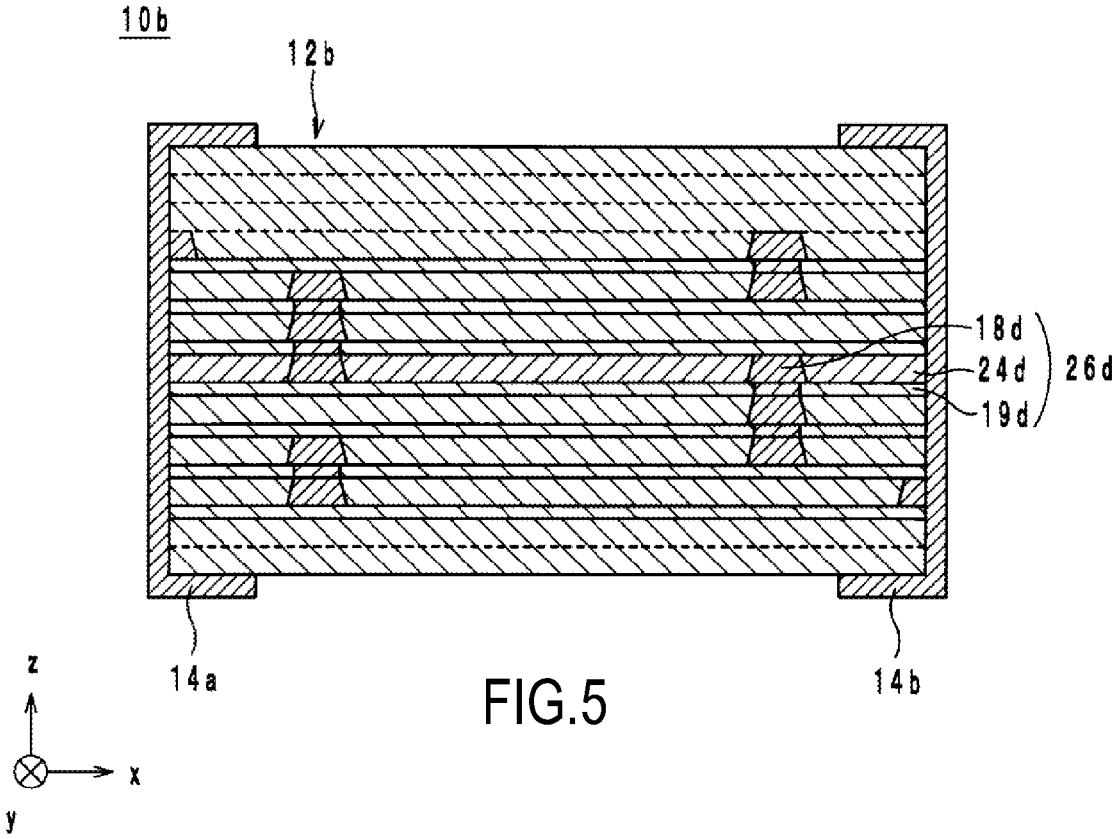
FIG. 5 is a structural sectional view of an electronic component according to a first exemplary modification.

An electronic component 10*b* according to a first exemplary modification and an exemplary method of manufacturing the electronic component 10*b* are now described with reference to FIG. 5, which is a structural sectional view of the electronic component 10*b* according to the first exemplary modification. In order to avoid the complexity of FIG. 5, some of reference numerals representing the same members as those shown in FIG. 3, which can be present in the first exemplary modification, are not shown in FIG. 5.

A difference between the electronic component 10*a* and the electronic component 10*b* is that the electronic component 10*b* includes an insulating layer 24*d* which is non-magnetic instead of the insulating layer 16*d*, which is magnetic. This allows the insulating layer 24*d*, which is non-magnetic, to cross a coil L. Therefore, magnetic saturation due to a magnetic flux ϕ1 is prevented from occurring in the electronic component 10*b*.

In the exemplary method of manufacturing the electronic component 10*b*, a via-hole conductor b4 is formed in a ceramic green sheet for forming an insulating layer 19*d*. A procedure for forming the via-hole conductor b4 is as described above and therefore will not be repeated here.

A coil conductor 18*d* is formed on the ceramic green sheet for forming the insulating layer 19*d*. A procedure for forming the coil conductor 18*d* is as described above and therefore will not be repeated here.

A ceramic green layer for forming the insulating layer 24*d* is formed on a portion of the ceramic green sheet for forming the insulating layer 19*d*, the portion being other than the coil conductor 18*d*. In particular, the ceramic green layer for forming the insulating layer 24*d* is formed in such a manner that a non-magnetic paste is applied to the portion by a process such as screen printing or photolithography. Through the above steps, a ceramic green layer for forming a unit layer 26*d* is formed.

Ceramic green sheets for forming insulating layers 15*a* to 15*c*; ceramic green layers for forming unit layers 17*a* to 17*c*, 26*d*, and 17*e* to 17*g*; and ceramic green sheets for forming insulating layers 15*d* and 15*e* are stacked in that order and are then press-bonded, whereby an uncalcined mother laminate is obtained. Other steps of the method of manufacturing the electronic component 10*b* are the same as those of the method of manufacturing the electronic component 10*a* and therefore will not be repeated here.

Figure 6:
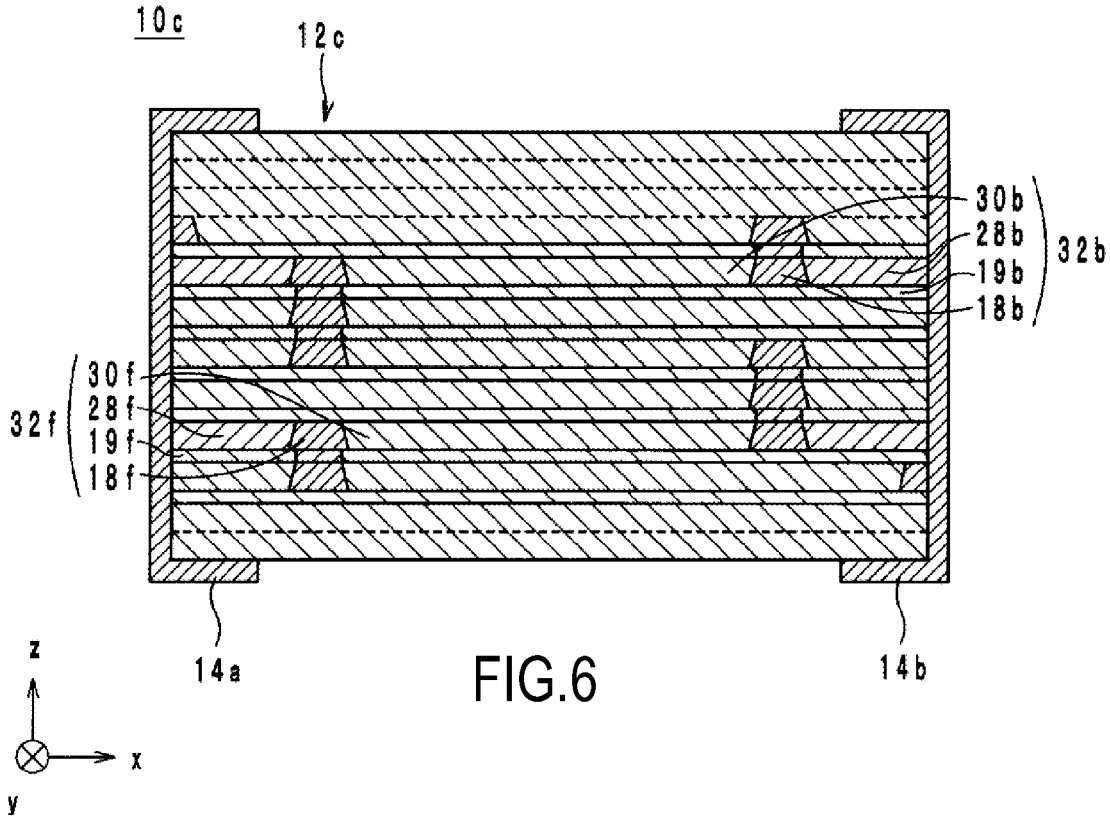
FIG. 6 is a structural sectional view of an electronic component according to a second exemplary modification.

An electronic component 10*c* according to a second exemplary modification and an exemplary method of manufacturing the electronic component 10*c* are now described with reference to FIG. 6, which is a structural sectional view of the electronic component 10*c* according to the second modification. In order to avoid the complexity of FIG. 6, some of reference numerals representing the same members as those shown in FIG. 3, which can be present in the second exemplary modification, are not shown in FIG. 6.

A difference between the electronic component 10*a* and the electronic component 10*c* is that the electronic component 10*c* includes insulating layers 28*b* and 28*f* which are non-magnetic and insulating layers 30*b* and 30*f* which are magnetic instead of the insulating layers 16*b* and 16*f*, which are magnetic. That is, in the electronic component 10*c*, the insulating layers 28*b* and 28*f*, which are non-magnetic, are arranged outside a coil L. This allows a magnetic flux ϕ1 to pass through the insulating layers 30*b* and 30*f*, which are magnetic, thereby preventing magnetic saturation due to the magnetic flux ϕ1 from occurring in the electronic component 10*c*.

In the exemplary method of manufacturing the electronic component 10*c*, via-hole conductor b2 and b6 are formed in ceramic green sheets for forming insulating layers 19*b* and 19*f*. A procedure for forming the via-hole conductors b2 and b6 is as described above and therefore will not be repeated here.

Coil conductors 18*b* and 18*f* are formed on the ceramic green sheets for forming the insulating layers 19*b* and 19*f*. A procedure for forming the coil conductors 18*b* and 18*f* is as described above and therefore will not be described.

Ceramic green layers for forming the insulating layers 28*b* and 30*b* are formed on portions of the ceramic green sheet for forming the insulating layer 19*b*, the portions being other than the coil conductor 18*b*. Ceramic green layers for forming the insulating layers 28*f* and 30*f* are formed on portions of the ceramic green sheet for forming the insulating layer 19*f*, the portions being other than the coil conductor 18*f*. In particular, the insulating layers 28*b* and 28*f* are formed on portions of the ceramic green sheets for forming the insulating layers 19*b* and 19*f*, the portions being outside the coil conductors 18*b* and 18*f*. The insulating layers 30*b* and 30*f* are formed on portions of the ceramic green sheets for forming the insulating layers 19*b* and 19*f*, the portions being inside the coil conductors 18*b* and 18*f*. The ceramic green layers for forming the insulating layers 28*b* and 28*f* are made from a non-magnetic ceramic paste (that is, a ceramic paste containing no Ni). The ceramic green layers for forming the insulating layers 30*b* and 30*f* are made from a magnetic ceramic paste (that is, a ceramic paste containing Ni). The magnetic and non-magnetic ceramic pastes are applied to the portions by a process such as screen printing or photolithography, whereby the ceramic green layers for forming the insulating layers 28*b*, 28*f*, 30*b*, and 30*f* are formed. Through the above steps, ceramic green layers for forming unit layers 32*b* and 32*f* are formed.

Ceramic green sheets for forming insulating layers 15*a* to 15*c*; ceramic green layers for forming unit layers 17*a*, 32*b*, 17*c* to 17*e*, 32*f*, and 17*g*; and ceramic green sheets for forming insulating layers 15*d* and 15*e* are stacked in that order and are then press-bonded, whereby an uncalcined mother laminate is obtained. Other steps of the method of manufacturing the electronic component 10*c* are the same as those of the method of manufacturing the electronic component 10*a* and therefore will not be repeated here.

Figure 7:
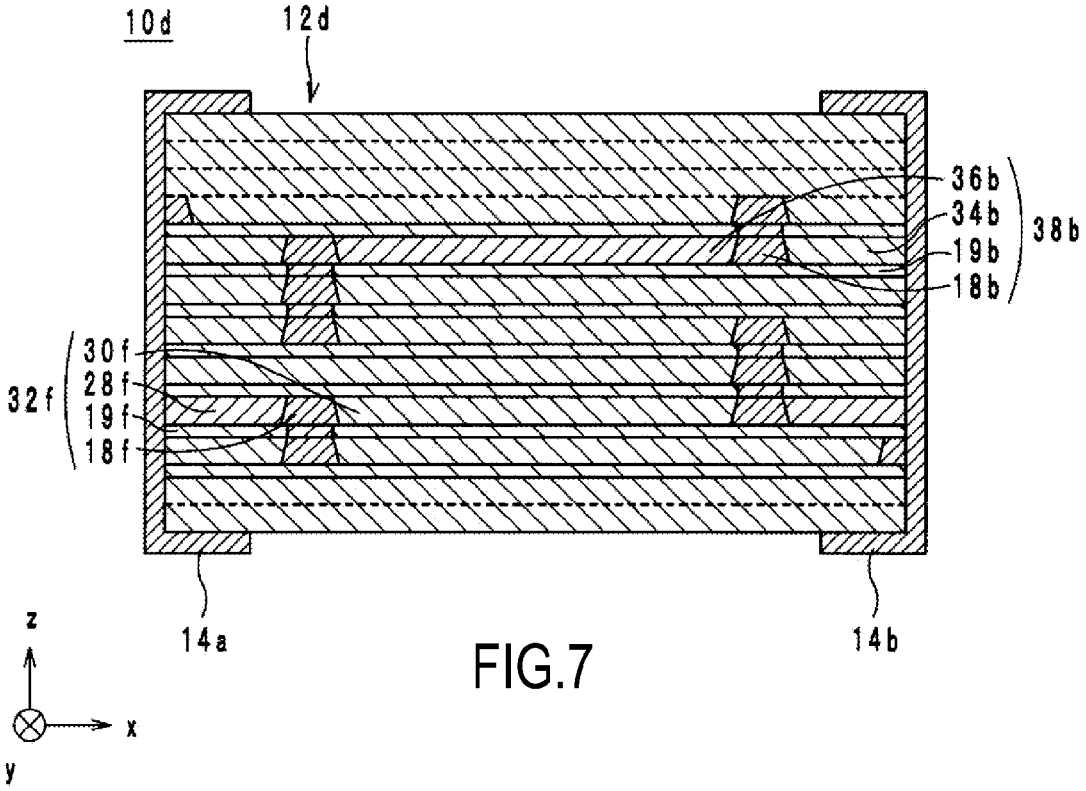
FIG. 7 is a structural sectional view of an electronic component according to a third exemplary modification.
Figure 8:
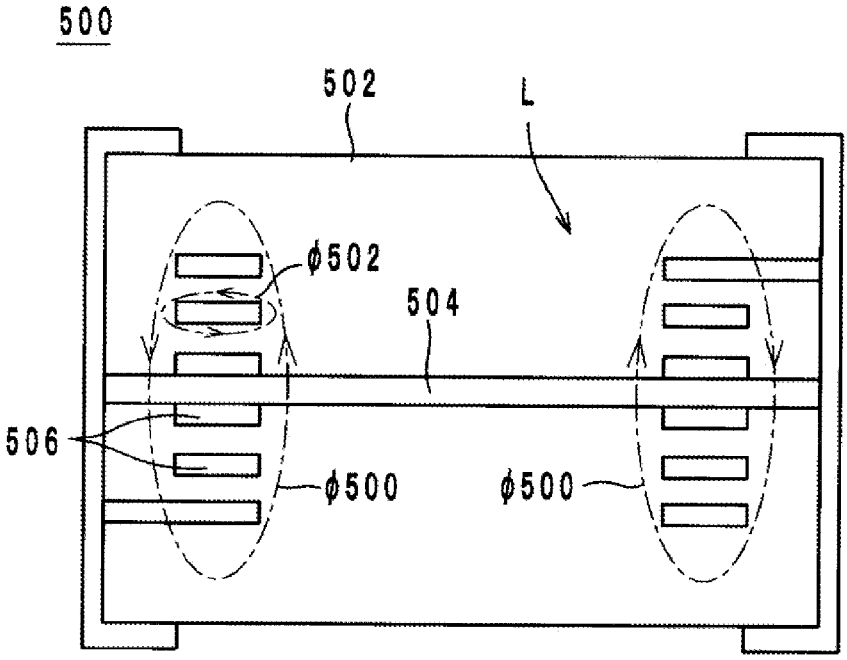
FIG.8 Prior Art
FIG. 8 is a sectional view of an open magnetic circuit-type laminated coil component disclosed in Patent Literature 1.

An electronic component 10*d* according to a third exemplary modification and an exemplary method of manufacturing the electronic component 10*c* are now described with reference to FIG. 7, which is a structural sectional view of the electronic component 10*d* according to the third exemplary modification. In order to avoid the complexity of FIG. 7, some of reference numerals representing the same members as those shown in FIG. 3, which can be present in the third exemplary modification, are not shown FIG. 7.

A first difference between the electronic component 10*a* and the electronic component 10*d* is that the electronic component 10*d* includes an insulating layer 36*b* that is non-magnetic and an insulating layer 34*b* that is magnetic instead of the insulating layer 16*b*, which is magnetic. A second difference between the electronic component 10*a* and the electronic component 10*d* is that the electronic component 10*d* includes an insulating layer 28*f* which is non-magnetic and an insulating layer 30*f* which is magnetic instead of the insulating layer 16*f*, which is magnetic.

In the electronic component 10*d*, the insulating layer 36*b*, which is non-magnetic, is placed inside a coil L and the insulating layer 28*f*, which is non-magnetic, is placed outside the coil L. This allows a magnetic flux ϕ1 to pass through the insulating layers 36*b* and 28*f*, which are non-magnetic, thereby preventing magnetic saturation due to the magnetic flux ϕ1 from occurring in the electronic component 10*d*.

In the exemplary method of manufacturing the electronic component 10*d*, via-hole conductors b2 and b6 are formed in ceramic green sheets for forming insulating layers 19*b* and 19*f*. A procedure for forming the via-hole conductors b2 and b6 is as described above and therefore will not be repeated here.

Coil conductors 18*b* and 18*f* are formed on the ceramic green sheets for forming the insulating layers 19*b* and 19*f*. A procedure for forming the coil conductors 18*b* and 18*f* is as described above and therefore will not be repeated here.

Ceramic green layers for forming the insulating layers 34*b* and 36*b* are formed on portions of the ceramic green sheet for forming the insulating layer 19*b*, the portions being other than the coil conductor 18*b*. Ceramic green layers for forming the insulating layers 28*f* and 30*f* are formed on portions of the ceramic green sheet for forming the insulating layer 19*f*, the portions being other than the coil conductor 18*f*. In particular, the insulating layer 34*b* is formed on a portion of the ceramic green sheet for forming the insulating layer 19*b*, the portion being outside the coil conductor 18*b*. The insulating layer 36*b* is formed on a portion of the ceramic green sheet for forming the insulating layer 19*b*, the portion being inside the coil conductor 18*b*. The insulating layer 28*f* is formed on a portion of the ceramic green sheet for forming the insulating layer 19*f*, the portion being outside the coil conductor 18*f*. The insulating layer 30*f* is formed on a portion of the ceramic green sheet for forming the insulating layer 19*f*, the portion being inside the coil conductor 18*f*. The ceramic green layers for forming the insulating layers 28*f* and 36*b* are made from a non-magnetic ceramic paste (that is, a ceramic paste containing no Ni). The ceramic green layers for forming the insulating layers 30*f* and 34*b* are made from a magnetic ceramic paste (that is, a ceramic paste containing Ni). The magnetic and non-magnetic ceramic pastes are applied to the portions by a process such as screen printing or photolithography, whereby the ceramic green layers for forming the insulating layers 28*f*, 30*f*, 34*b*, and 36*b* are formed. Through the above steps, ceramic green layers for forming unit layers 38*b* and 32*f* are formed.

Ceramic green sheets for forming insulating layers 15*a* to 15*c*; ceramic green layers for forming unit layers 17*a*, 38*b*, 17*c* to 17*e*, 32*f*, and 17*g*; and ceramic green sheets for forming insulating layers 15*d* and 15*e* are stacked in that order and are then press-bonded, whereby an uncalcined mother laminate is obtained. Other steps of the method of manufacturing the electronic component 10*d* are the same as those of the method of manufacturing the electronic component 10*a* and therefore will not be described.

The electronic components 10*a* to 10*d* are prepared by a sequential press-bonding process and may be prepared by a printing process.

Embodiments consistent with the present disclosure are useful for providing an electronic component and a method of manufacturing the same. Such embodiments are excellent in being capable of preventing the occurrence of magnetic saturation due to a magnetic flux surrounding each coil conductor.

That which is claimed is:

1. An electronic component, comprising a plurality of unit layers, each said unit layer comprising:

a single sheet-shaped first insulating layer;

a coil conductor on the first insulating layer; and a second insulating layer on a portion of the first insulating layer, the portion being other than the coil conductor, wherein the unit layers are continuously stacked such that the coil conductors are connected to each other to form a spiral coil, the first insulating layers include first portions sandwiched between the coil conductors in the stacking direction and second portions other than the first portions, the first portions have a Ni content lower than a Ni content of the second portions, and the Ni content of the second portions is lower than a Ni content of the second insulating layers.

* * * * *